US006550941B1

(12) United States Patent
Keuper et al.

(10) Patent No.: US 6,550,941 B1
(45) Date of Patent: Apr. 22, 2003

(54) LUMINAIRE

(75) Inventors: Matthijs H. Keuper, Eindhoven (NL); Helmar Van Santen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 37 days.

(21) Appl. No.: 09/717,507

(22) Filed: Nov. 21, 2000

(30) Foreign Application Priority Data

Nov. 29, 1999 (EP) ..... 99204012

(51) Int. Cl.[7] ..... F21V 5/00
(52) U.S. Cl. ..... 362/337; 362/237; 362/240
(58) Field of Search ..... 362/235, 237, 362/240, 244, 332, 336, 337, 338, 339

(56) References Cited

U.S. PATENT DOCUMENTS 4,519,675 A 5/1985 Bar-Yonah ..... 350/259
6,048,083 A * 4/2000 McDermott ..... 362/337
6,250,777 B1 * 6/2001 Aoyama ..... 359/726
6,367,950 B1 * 4/2002 Yamada et al. ..... 362/241

FOREIGN PATENT DOCUMENTS

DE 4305585 A1 8/1994 ..... F21Q/1/00
WO 9855798 6/1998

* cited by examiner

*Primary Examiner*—Sandra O'Shea
*Assistant Examiner*—John Anthony Ward
(74) *Attorney, Agent, or Firm*—Frank J. Keegan

(57) ABSTRACT

A luminaire suitable for accommodating a light source which light source is situated substantially in a first plane. The luminaire has an optical element which is situated substantially in a second plane. The optical element is provided with facets of mutually differing inclination angles at one or both sides. The facets are shaped as substantially parallel prisms. Consecutive facets form a surface which is alternately convex and concave in shape.

19 Claims, 2 Drawing Sheets

LUMINAIRE

BACKGROUND OF THE INVENTION

The invention relates to a luminaire suitable for accommodating a light source which lies substantially in a first plane, comprising an optical element which lies substantially in a second plane, while said optical element is provided at one side or both sides with facets having different inclination angles, which facets are formed mainly by parallel prisms. The invention is also concerned with an optical element suitable for use in such a luminaire.

Such a luminaire is known from DE-A-43 05 585. A collimated light beam can be made to change its direction by means of such a luminaire. Facets may be used in two different ways for this purpose. A first way is that refraction occurs at the facets. This applies to a deflection of the light by an angle of at most 30°. A second way is that a full internal reflection takes place at a surface of the facets. This is a suitable way for achieving deflection angles of between 25° and 90°. It is possible by means of a matrix of such facets to form a plurality of beams which shine in different directions. At a longer distance, these beams merge (are superimposed), which renders it possible to make a beam of any shape whatsoever. It is thus possible to achieve a highly complex and accurate light distribution as desired by a user. It is even possible to project a text with such a matrix.

It is very difficult, however, to manufacture such a matrix of facets. This situation can be strongly improved in that the matrix is built up from a number of rows of facets, the facets of each row enclosing a fixed angle, which lies in a third plane perpendicular to the row and perpendicular to the second plane, with a perpendicular on the second plane, and enclose an angle with said perpendicular in a fourth plane through the row which is perpendicular to the second plane, which angle changes progressively along the row from one facet to the next. The fixed angle in the third plane varies from row to row. The optical element has a sawtooth structure in an embodiment, the facets being formed by substantially parallel prisms. In this case a prism preferably has curved sides, as seen in a direction in the plane of the optical element. Such prisms can be provided on a lens or a lens mold in a simple manner by means of a shaping tool. An optical element thus formed for a luminaire is suitable for shaping medium-wide beams and can be industrially manufactured in a reliable manner in batch production.

Problems arise, however, when beams of large deflection angles are to be formed. A first problem is that the required angle variation in the fourth plane leads to the formation of steeply rising rows which in their turn give rise to the formation of an impractically large height of the optical element. A second problem is that light fully reflected in facets of a first row is intercepted by a second, adjoining row under certain circumstances owing to the increasing dimensions of the prisms of consecutive rows. A shadow effect of one or several rows will then arise.

SUMMARY OF THE INVENTION

The invention has for its object to solve the above problems. According to the invention, a luminaire of the kind mentioned in the opening paragraph is for this purpose provided with an optical element in which consecutive facets of a row form a surface which is alternately concave and convex in shape. An advantage of this is that the overall construction of the optical element requires a smaller height. A further improvement can be realized in that consecutive rows are situated at mutually differing distances from the second plane. A further improvement in the prevention of shadow effects can be achieved when those rows from among consecutive rows of facets for the purpose of full internal reflection which have a greatest fixed angle are at a greatest distance to the second plane. An improved beam formation of the light issuing from the luminaire can thus be realized, while the advantage of comparatively small dimensions of the optical element is retained.

In a preferred embodiment of the luminaire, the light source comprises a plurality of light sources. Preferably, the light sources are collimated light sources. The formation of parallel beams from the light of the plurality of light sources, by means of reflection and/or refraction, before this light hits the optical element renders it possible to achieve an accurate light distribution of the output beam. Highly suitable light sources are light-emitting diodes (LEDs).

BRIEF DESCRIPTION OF THE DRAWINGS

The above and further aspects of the invention will now be explained in more detail with reference to a drawing of an embodiment of a luminaire according to the invention. In the drawing.

DETAILED DESCRIPTION OF THE PREFERRED EMBODIMENTS

Figure 1:
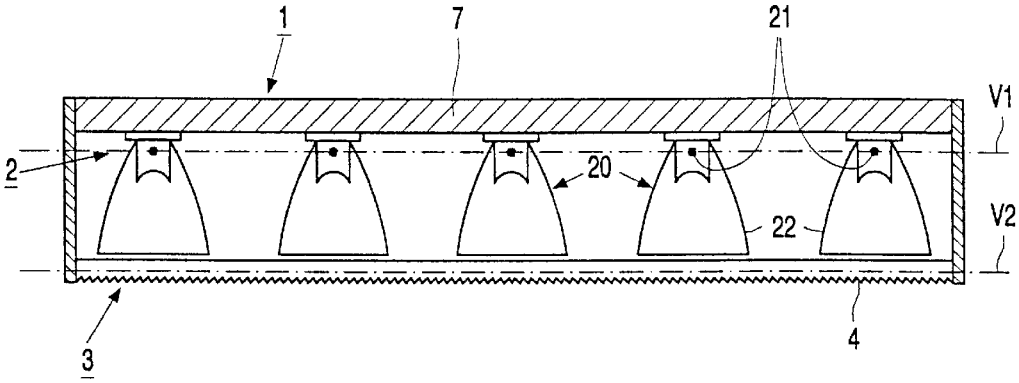
FIG. 1 shows a luminaire.

FIG. 1 shows a luminaire 1 suitable for accommodating a light source 2, which is present substantially in a first plane V1, and comprising an optical element 3, which is present substantially in a second plane V2, which optical element is provided with facets 4 at one side. The light source 2 comprises a plurality of collimated light sources 20, in the case shown in the form of light-emitting diodes (LEDs) 21, each of which is provided with a collimator lens 22. The luminaire comprises a housing which is closed off at one side by the optical element 3.

Figure 2:
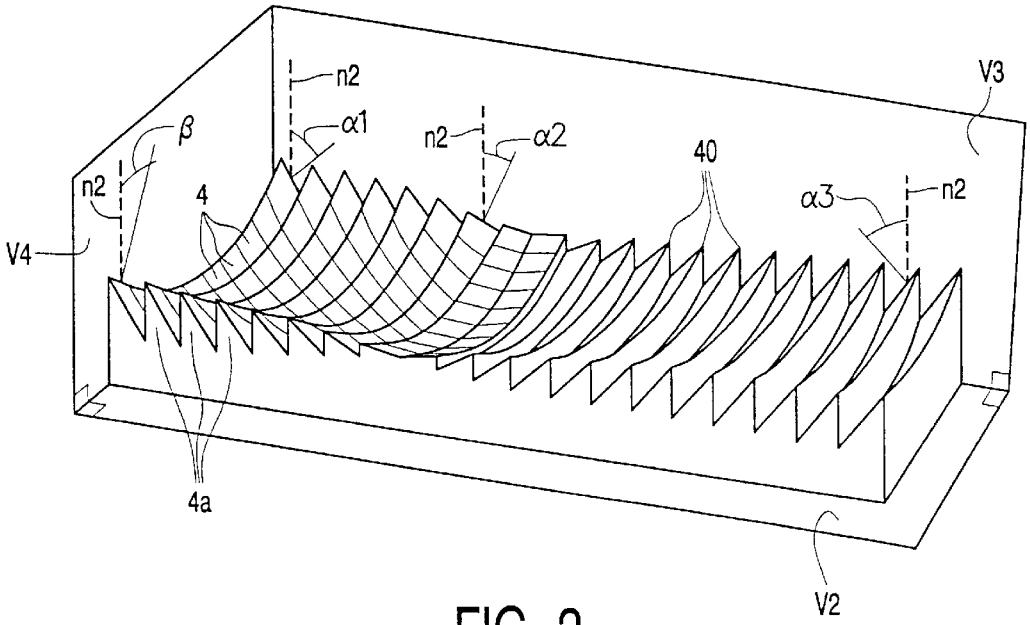
FIG. 2 is an elevation of a known optical element designed for use in the luminaire of FIG. 1.

A known optical element 3 suitable for use in a luminaire as shown in FIG. 1 is shown in detail in FIG. 2. It is visible in FIG. 2 that the facets 4 of the optical element 3 have mutually differing inclination angles. The facets 4 are formed by substantially parallel prisms 4*a*. The facets 4 are arranged in a number of rows 40 of facets, such that the facets of each row enclose a fixed angle $\alpha 1$, $\alpha 2$, $\alpha 3$ lying in a third plane V3 perpendicular to the row and perpendicular to the second plane V2 with a perpendicular n2 on the second plane, and enclose an angle $\beta$, which changes progressively along the row from one facet to the next, with the perpendicular n2 in a fourth plane V4 through the row, which plane is perpendicular to the second plane V2. The fixed angle $\alpha 1$, $\alpha 2$, $\alpha 3$ in the third plane varies from row to row 40. It is visible in the Figure that for facets which contribute to the beam formation of the light by means of full internal reflection (for angles $\alpha \geqq 38°$ at a refractive index of 1.6), the light reflected by those with a smaller fixed angle $\alpha$ is intercepted by the facets of an adjoining row with a larger fixed angle $\alpha$.

Figure 3:
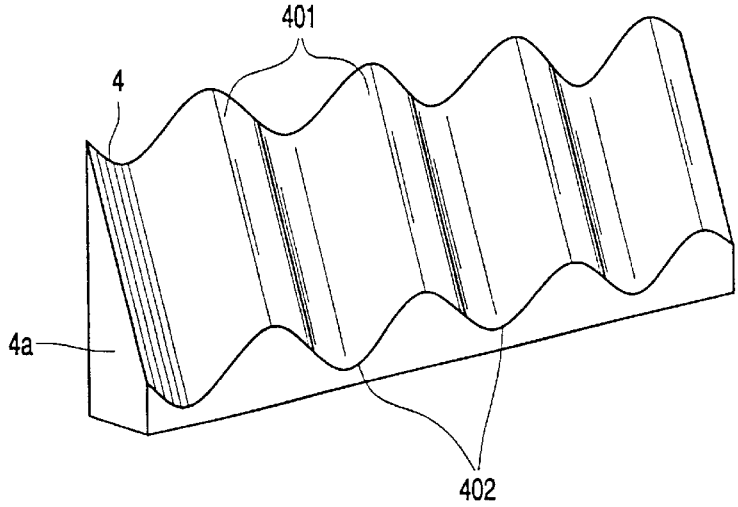
FIG. 3 shows an optical element according to the invention.

FIG. 3 shows an optical element 2 according to the invention provided with a single row of facets 4. The consecutive facets 4 form a surface which is alternately concave 402 and convex 401 in shape. Such an optical element can be obtained in that facets change their mutual positions under consulation of their individual angles ($\alpha$,$\beta$) starting from a row of facets as shown in FIG. 2. By choosing the width of the thus changed facets comparatively small, it is possible to repeat a sequence of facets thus formed a few times in each row. The alternately convex and concave surface is formed thereby, while the optical beam-forming properties of the row of facets are retained. The design of the optical element as described can be obtained, for example, by means of a computer calculation on the basis of the shape of the known optical element.

Figure 4:
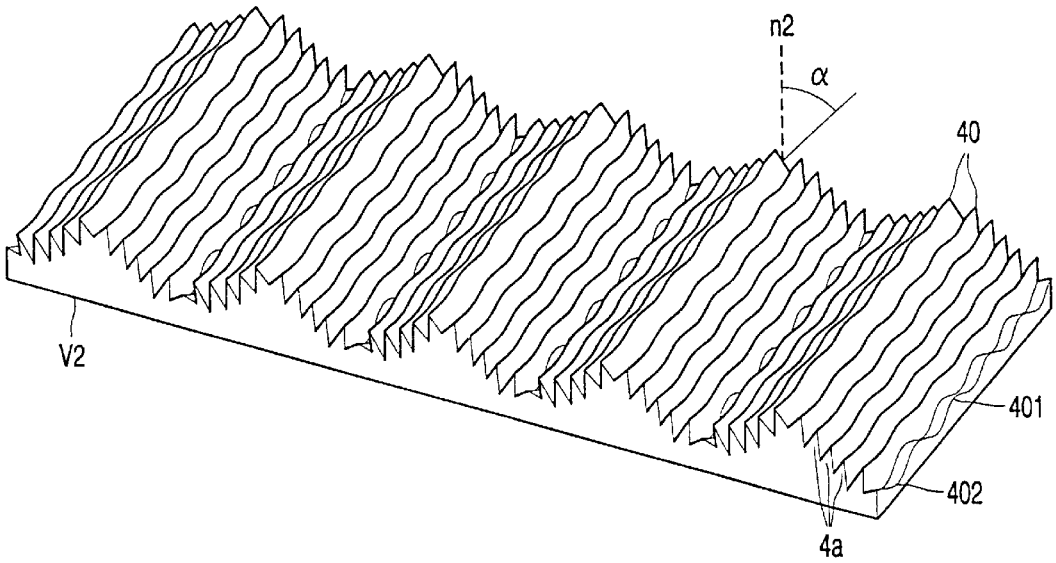
FIG. 4 shows a further modification of an optical element according to the invention.

FIG. 4 shows a further modification of an optical element 2 according to the invention, provided with a large number of rows 40 of facets formed by prisms 4*a,* wherein those facets having a smallest fixed angle $\alpha$ in consecutive rows containing facets for full internal reflection are at a greatest distance to the second plane V2. In a manner similar to the manner described above with reference to the optical element of FIG. 3, the optical element of FIG. 4 can be realized through a mutual interchanging of the positions of the rows of facets, starting from the shape of the known optical element. Again, this design can be implemented by means of a computer calculation.

The scope of protection of the invention is not limited to the embodiments given. The invention resides in each novel characteristic and any combination of characteristics. The use of the verb "comprise" does not exclude the presence of elements other than those mentioned in the claims.

What is claimed is:

1. A luminaire suitable for accommodating a light source which lies substantially in a first plane, comprising an optical element which lies substantially in a second plane, said optical element is provided at one or both sides with facets formed mainly as parallel prisms, said facets being arranged in a matrix configuration such that the facets of each respective row of said matrix enclose a fixed angle, $\alpha_1$–$\alpha_N$, lying in a third plane perpendicular to said second plane said facets of each of said respective rows further enclosing an angle $\beta$, which changes progressively along each of said respective rows from facet to facet, said angle B lying in a fourth plane perpendicular to said second and third planes, and wherein said facet matrix forms an overall surface which is alternately concave and convex in shape.

2. A luminaire as claimed in claim 1, wherein the facets of consecutive rows are situated at mutually differing distances from the second plane.

3. A luminaire as claimed in claim 2, wherein those rows from among consecutive rows of facets for the purpose of full internal reflection which have a smallest fixed angle are at a greatest distance to the second plane.

4. A luminaire as claimed in claim 1, wherein the light source comprises a plurality of light sources.

5. A luminaire as claimed in claim 4, wherein the light sources are collimated light sources.

6. A luminaire as claimed in claim 4, wherein the light sources are light-emitting diodes (LEDs).

7. An optical element suitable for use in a luminaire as claimed in claim 1.

8. The luminaire of claim 1, wherein light reflected by faces having a smaller fixed angle in a respective row of said matrix is intercepted by facets of an adjoining row of said matrix having a larger fixed angle.

9. A luminaire suitable for accommodating a light source which light source lies substantially in a first plane, said luminaire comprising an optical element which lies substantially in a second plane, said optical element is provided, on at least one side, with facets, the facets being formed mainly by parallel prisms, said facets being arranged in a matrix configuration such that the facets of each respective row of said matrix enclose a fixed angle, $\alpha_1$–$\alpha_N$, lying in a third plane perpendicular to said second plane, said facets of each of said respective rows further enclosing an angle $\beta$, which changes progressively along each of said respective rows from facet to facet, said angle B lying in a fourth plane perpendicular to said second and third planes, and wherein said facet matrix forms an overall surface which is alternately concave and convex in shape.

10. A luminaire as claimed in claim 9, wherein the facets of consecutive rows are situated at mutually differing distances from the second plane.

11. A luminaire as claimed in claim 9, wherein one or more of the rows from among the consecutive rows of facets which have a smallest fixed angle enclosed by said row are at a greatest distance from the second plane.

12. A luminaire as claimed in claim 9, wherein the light source comprises a plurality of light sources.

13. A luminaire as claimed in claim 9, wherein the light sources are collimated light sources.

14. A luminaire as claimed in claim 9, wherein the light sources are light-emitting diodes (LEDs).

15. A luminaire as claimed in claim 9, wherein the consecutive edge of one or more of said facets is along the length of the parallel prisms.

16. An optical element for use with a light source which light source lying substantially in a first plane, the optical element comprising a light transmitting material formed to lie substantially in a second plane, said optical element having two sides and being provided at one side or both sides with facets having different inclination angles, the facets being formed mainly by parallel prisms, said facets being arranged in a matrix configuration such that the facets of each respective row of said matrix enclose a fixed angle, $\alpha_1$–$\alpha_N$, lying in a third plane perpendicular to said second plane, said facets of each of said respective rows further enclosing an angle $\beta$, which changes progressively along each of said respective rows from facet to facet, said angle B lying in a fourth plane perpendicular to said second and third plane, and wherein said facet matrix forms an overall surface which is alternately concave and convex in shape.

17. An optical element as claimed in claim 16, wherein the facets of consecutive rows are situated at mutually differing distances from the second plane.

18. An optical element as claimed in claim 16, wherein one or more of the rows from among the consecutive rows of facets which have a smallest fixed angle enclosed by said row are at a greatest distance from the second plane.

19. A luminaire as claimed in claim 16, wherein the consecutive edge of one or more of said facets is along the length of the parallel prisms.

* * * * *